United States Patent [19]

Nishimiya et al.

[11] Patent Number: 4,617,889

[45] Date of Patent: Oct. 21, 1986

[54] IDLE SPEED CONTROL DEVICE

[75] Inventors: Torazo Nishimiya, Mito; Tomoo Ito, Katsuta; Takashi Iseyama, Minori, all of Japan

[73] Assignee: Hitachi, Ltd., Tokyo, Japan

[21] Appl. No.: 721,767

[22] Filed: Apr. 10, 1985

[30] Foreign Application Priority Data

Apr. 11, 1984 [JP] Japan ..... 59-70872
Sep. 4, 1984 [JP] Japan ..... 59-186161

[51] Int. Cl.[4] ..... F02M 3/00

[52] U.S. Cl. ..... 123/339; 123/585; 251/129.08

[58] Field of Search ..... 123/339, 340, 341, 585, 123/586, 587, 588; 251/129.08, 331; 137/625.34

[56] References Cited

U.S. PATENT DOCUMENTS

| | | | |
|---|---|---|---|
| 4,077,674 | 3/1978 | Doto | 251/129.08 |
| 4,314,585 | 2/1982 | Nishimiya et al. | 251/129.08 |
| 4,380,979 | 4/1983 | Takase | 123/341 |
| 4,389,996 | 6/1983 | Yaegashi et al. | 123/585 |
| 4,446,832 | 5/1984 | Matsumura et al. | 123/339 |
| 4,453,700 | 6/1984 | Otsuki et al. | 123/585 |
| 4,475,505 | 10/1984 | Hasegawa et al. | 123/339 |
| 4,541,379 | 9/1985 | Raschek et al. | 123/339 |

*Primary Examiner*—Raymond A. Nelli
*Attorney, Agent, or Firm*—Antonelli, Terry & Wands

[57] ABSTRACT

An idle speed control device has an electromagnetic driving portion and a flow rate controlling portion disposed in a bypass passage formed in a throttle chamber such as to bypass a throttle valve. The flow rate controlling portion has a body defining a passage for the fluid to be controlled, a seal formed in an intermediate portion of the passage, a first valve driven by the plunger of the electromagnetic driving portion through a rod such as to be brought into and out of contact with the seat, a sleeve disposed in the body, and a second valve connected through a rod to the downstream side of the first valve such as to produce a vacuum force which acts in the opposite direction to the vacuum force produced on the first valve thereby to absorb any fluctuation in the intake pressure in cooperation with the first valve, the second valve being loosely received by the sleeve. According to this arrangement, it is possible to eliminate any unfavorable effect of the fluctuation in the intake vacuum on the actual air flow rate. In addition, since the flow from the vacuum compensating portion is minimized, the vacuum compensation is made possible without incurring any increase in the initial leak.

8 Claims, 11 Drawing Figures

IDLE SPEED CONTROL DEVICE

BACKGROUND OF THE INVENTION

The present invention relates to an idle speed control device suitable for use as an electronic control actuator which operates to set the idle speed of an automotive engine automatically at a desired speed in response to change in the cooling water temperature or the ambient air temperature. More particularly, the invention is concerned with an idle speed control device of the type mentioned above, having an improved construction of the flow-rate controlling portion thereof.

An actuator has been known which is designed for automatically controlling the idle speed of automotive engine in response to a change in the cooling water temperature or in the intake vacuum. This known actuator has a flow rate controlling section which includes a body defining a passage of air to be controlled, a pair of seats formed on an intermediate portion of the body, and a pair of metering valves fixed to the rod of an electromagnetic actuator. An example of this type of idle speed control device is shown in the U.S. Pat. No. 4,314,585. The actuator, which is constituted by an electromagnetic driving portion for converting an electric input into a mechanical output and the flow rate control section mentioned above, is adapted to be controlled by a processing circuit which performs a predetermined computation upon receipt of signals from a water temperature sensor and a crank angle sensor, in such a manner as to control the flow-rate of bypass air such as to maintain a desired engine speed.

Thus, the actuator conducts an automatic and continuous control such as to maintain the idle speed at a predetermined speed, upon sensing the cooling water temperature and the engine speed.

As mentioned before, the known actuator has a flow-rate control section which is constituted by a pair of seats and a pair of metering valves adapted for cooperation with these seats. In this flow-rate control section, for the reason concerning the assembly, one of the seats has a diameter greater than that of the other. Since the cross-sectional area of passage between one seat and the cooperating valve and that between the other seat and the associated valve differ from each other, the vacuum forces determined by such cross-sectional areas differ from each other, and the vacuum forces tend to be inverted at an intermediary.

As will be understood from the foregoing statement, the flow-rate characteristics of the conventional actuator is liable to be affected by the pressure differential across the metering valves. More specifically, as shown in FIG. 10, the flow-rate characteristic curve a as obtained when the intake vacuum is −500mmHg crosses the curve b showing the flow-rate characteristics as obtained when the intake vacuum is −600mmHg, at an intermediate level of the electric input. Namely, selecting the flow-rate characteristic curve a as the standard or reference, the flow rates obtained at different intake vacuum level expressed by the curve b is smaller than the reference value when the electric input is rather small but becomes greater than the reference value when the electric input is rather large.

Thus, the flow-rate characteristics tend to be inverted at an intermediate level of the electric input when the pressure differential is large, so that a complicated controlling software is required.

It is to be noted also that the levels of vacuum force which act on both sides of a pair of metering valves are not equalized. Namely, the vacuum force acting on one end of the pair of metering valves is greater than that acting on the other end. In consequence, a vacuum force as a disturbance is applied to the metering valve in addition to the electromagnetic force. Thus, the input-/output characteristics are affected by the pressure differential across the pair of metering valves, as will be seen from FIG. 11.

The conventional actuator involves a problem in that the initial leak is large particularly in the inoperative state, i.e., when the electric input is zero. Namely, in the flow-rate controlling portion which is constituted by a pair of valves and cooperating seats, it is extremely difficult to make the distance between two seats precisely coincide with the distance between two valves. Therefore, the close contact between the valve and the seat is failed in either one of the combination of the valve and the seat, so that a certain rate of initial leak is unavoidable. A large initial leak makes it impossible to set the idle speed at a low level. This is quite inconvenient from the view point of development of fuel saving and silent engine.

SUMMARY OF THE INVENTION

Accordingly, an object of the invention is to provide an idle speed control device, in which the unfavourable effect of the variation of the intake vacuum on the flow rate is suppressed to ensure a high precision of the control.

Another object of the invention is to provide an idle speed control device in which the air flow rate characteristics as obtained when the intake vacuum is changed does not cross the reference characteristics obtained at a predetermined level of intake vacuum.

Still another object of the invention is to provide an idle speed control device which permits a pressure differential compensation in the small input power region and an increase of the flow rate in the large input region.

A further object of the invention is to provide an idle speed control device which can minimize the initial leak.

To these ends, according to the invention, there is provided an idle speed control device wherein a flow rate controlling portion disposed in a bypass passage formed in a throttle chamber such as to bypass a throttle valve includes a body defining a passage for the fluid to be controlled, a seat formed in an intermediate portion of the passage, a first valve driven by the plunger of an electromagnetic driving portion through a rod such as to be brought into and out of contact with the seat, a sleeve disposed in the body, and a second valve connected through a rod to the downstream side of the first valve such as to produce a vacuum force which acts in the opposite direction to the vacuum force produced on the first valve thereby to absorb any fluctuation in the intake pressure in cooperation with the first valve, the second valve being loosely received by a sleeve.

In the idle speed control device of the invention, the metering portion and the vacuum compensation portion in combination eliminates the influence of the input vacuum on the output current flow rate which is determined in response to the input electric power level.

In addition, since the rate of flow from the vacuum compensating portion is small, the vacuum compensation can be made without causing any increase in the initial leak, so that the invention can be applied also to an engine having a low idle speed.

In addition, the flow rate characteristic curves at respective levels of the intake vacuum are positioned always either at the upper or lower side of the reference vacuum flow rate characteristic curve, without crossing the latter. Furthermore, the differential pressure compensation is effected only in the small input region in which such a compensation is necessary, whereas, in the large input region in which the differential pressure compensation is unnecessary, the flow rate can be increased advantageously.

DETAILED DESCRIPTION OF THE PREFERRED EMBODIMENTS

Embodiment 1

Figure 1:
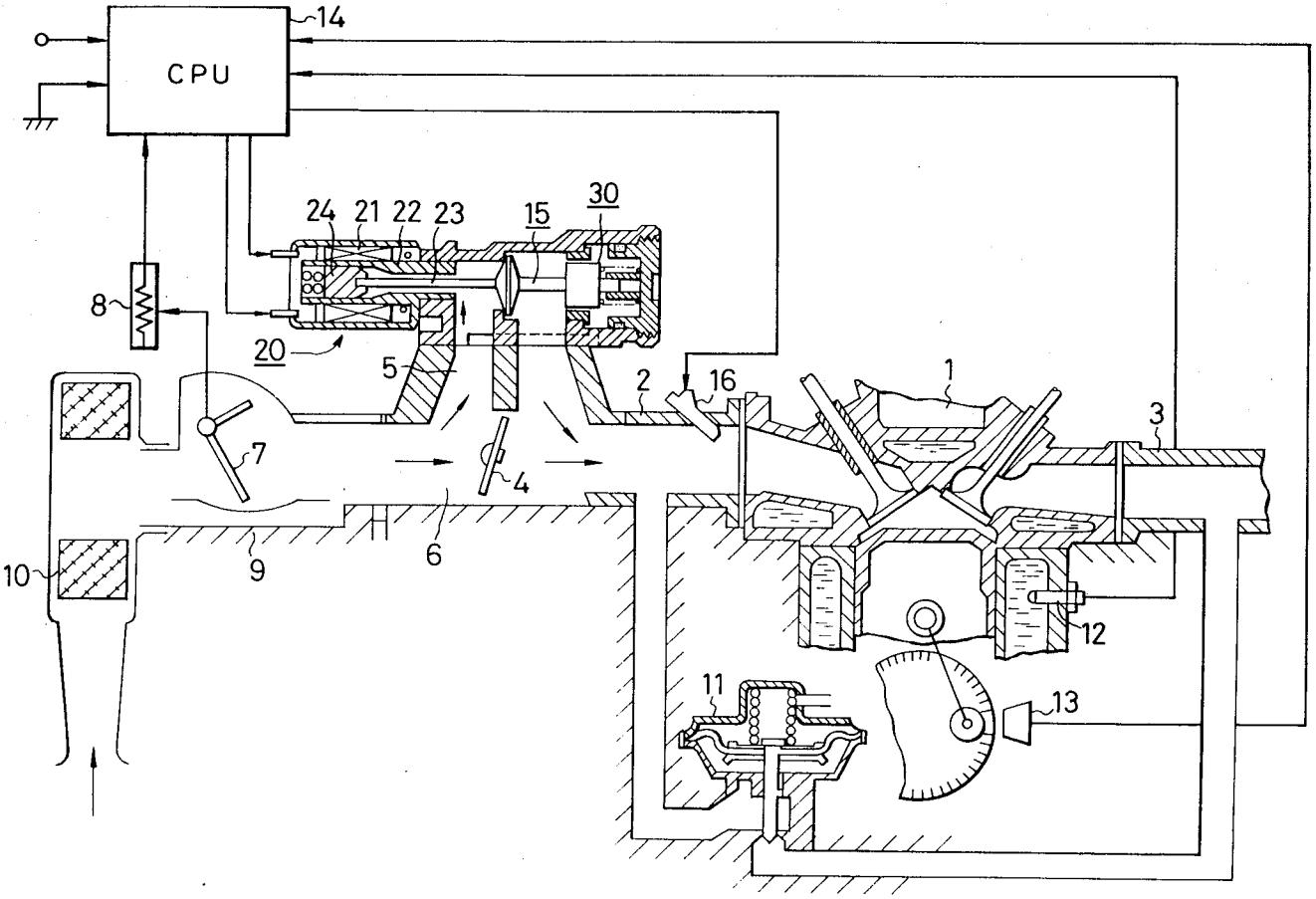
FIG. 1 is a system diagram of an engine equipped with an embodiment of an idle speed control device in accordance with the invention.

A description will be made hereinunder as to an engine system which is equiped with an idle speed control device in accordance with the invention. Referring to FIG. 1, an engine 1 is provided with an intake pipe 2 and an exhaust pipe 3. The intake pipe 2 has a throttle chamber 6 which in turn has a throttle valve 4 and a bypass passage 5. An air flowmeter 9 disposed at the upstreamside of the engine 1 is constituted by a vane 7 for measuring the air flow rate and a potentiometer 8 which converts the rotation angle of the vane 7 into an electric output. An air cleaner 10 is provided at the upstream side of the air flowmeter 9. An EGR valve 11 is disposed at an intermediate portion of a passage which provides a communication between the intake pipe 2 and the exhaust pipe 3, such as to return a part of the exhaust gas to the intake side. A water temperature sensor 12 is adapted to measure the temperature of the cooling water circulated in the engine 1 and adapted to convert the measured temperature into an electric output, while a crank angle sensor 13 is adapted to produce an electric output corresponding to the speed of the engine 1. A processing unit (CPU) 14 constitutes the center of an electronic engine control system. Namely, this processing unit is adapted to perform various computations in response to various input signals and to deliver predetermined control outputs to an idle speed control device 15 and a fuel injector 16.

The idle speed control device 15 is disposed in the bypass passage 5 in the throttle chamber 6 and is adapted to control the flow rate of the air which bypasses the throttle valve 4.

The idle speed control device 15 is composed of an electromagnetic driving portion 20 and a flow rate controlling portion 30, and is controlled by the output from the processing unit 14 which performs necessary computations upon receipt of signals from the water temperature sensor 12 and the crank angle sensor 13, such as to control the bypass air flow rate thus maintaining the desired idle speed of the engine 1.

The electromagnetic driving portion 20 of the idle speed control device 15 has a cylindrical coil 21 in which are disposed a core 22 and a plunger 24 connected to a rod 23. The opposing ends of the core 22 and the plunger 24 have frusto-conical surfaces. This electromagnetic driving portion 20 is adapted to convert the electric input supplied to the coil 21 into a mechanical output.

Figure 2:
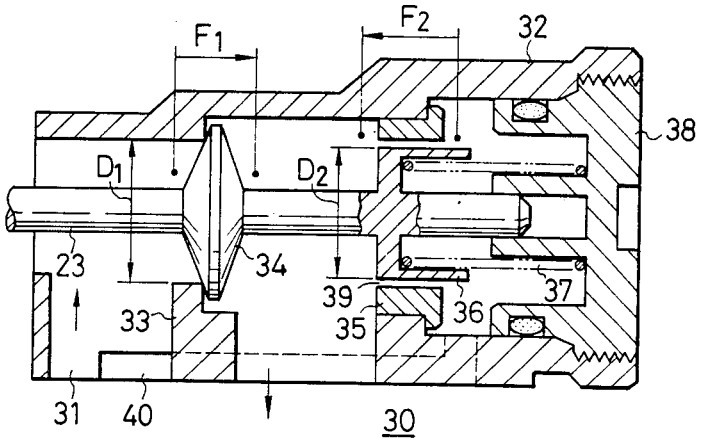
FIG. 2 is a partial sectional view of an idle speed control device as shown in FIG. 1.

As will be seen from FIG. 2, the flow rate control section 30 of the idle speed control device 15 has a body 32 which is provided with an air passage 31 or a passage of the fluid to be controlled, a seat 33 formed on an intermediate portion of the body 32, a metering valve 34 fixed to the rod 23 of the electromagnetic driving portion 20, a sleeve 35 attached to the body 32, a differential pressure compensating valve 36 loosely received in the sleeve 35, a spring 37 for pressing the compensating valve 36, and a valve guide 38. In this flow rate controlling portion 30, the seat 33 and the metering valve 34 constitute a metering portion 30A, while the sleeve 35 and the compensating valve 36 in combination constitute a vacuum compensating portion 30B.

The compensating valve 36 is fixed to the rod 23 together with the metering valve 34, such that the forces produced by vacuum act in opposite directions so as to negate each other. The combination between the sleeve 35 and the compensating valve 36 provides a labyrinth effect.

The vacuum compensating portion 30B has a clearance 39 formed between the sleeve 35 and the compensating valve 36. The clearance 39 serves only to transmit the pressure and does not allow the fluid to flow therethrough. A differential pressure introduction passage 40 transmits the pressure at the inlet of the metering valve 34 to the inlet side of the compensating valve 36.

When a predetermined pressure difference is developed across the metering valve 34, a force $F_1$ is generated to act on the metering valve 34 in the direction of the arrow $F_1$. Similarly, a force $F_2$ is produced to act on the compensating valve 36 as a result of the pressure differential across the valve 36, as will be seen from FIG. 2. The force $F_1$ is progressively changed in accordance with the change in the cross-sectional area of the opening as a result of stroking of the metering valve 34. In contrast, the force $F_2$ is not changed by the stroking because the cross-sectional area of the opening is constant in this case.

It may appear that this arrangement cannot provide balance of the forces produced by the pressure differential. Actually, however, the initial load produced by the spring 37 acts on the metering valve 34 and the compensating valve 36, so that the force $F_2$ is sufficiently small as compared with the force $F_1$ in the region of small input.

The diameter $D_1$ of the seat 33 is selected to be greater than the diameter $D_2$ of the compensating valve 36, so that the pressure receiving area of the metering valve 34 is greater than the pressure receiving area of the compensating valve 36 in the region of contact between the seat 33 and the metering valve 34.

Figure 3:
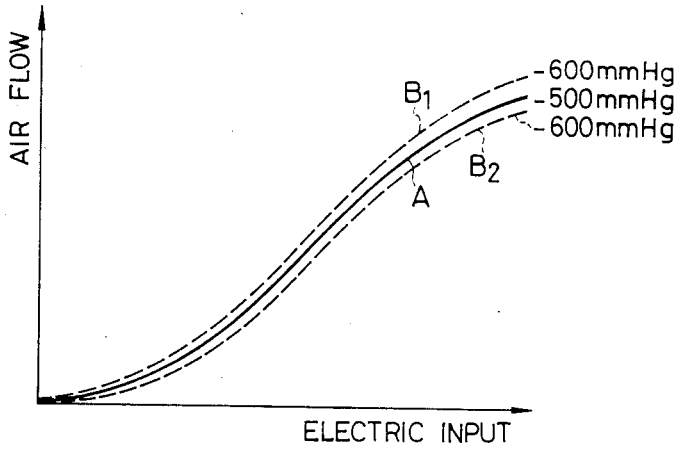
FIGS. 3 and 4 are air flow rate characteristic diagrams showing the air flow rate obtained in response to the electric input to the electromagnetic driving portion in the idle speed control device in accordance with the invention.

As shown by a curve $B_1$ in FIG. 3, the air flow rate characteristics are maintained always above the reference characteristic curve A in the same Figure, even when the intake vacuum is changed. It will be seen that any flow rate characteristics which is always below the reference characteristic curve A, the diameter $D_1$ of the seat 33 should be selected to be smaller than the diameter $D_2$ of the compensating valve 36. It is to be noted, however, if the diameter $D_2$ of the compensating valve 36 is selected to be too large as compared with the diameter $D_1$ of the seat 33, the force $F_2$ produced by the differential pressure becomes greater than the force $F_1$. In addition, there is an initial load imposed by the spring 37. In this case, therefore, the metering valve 34 does not start to move unless a considerably large electric input is applied, so that the rise of the air flow rate is delayed. Therefore, the diameter $D_2$ of the compensating valve 36 in relation to the diameter $D_1$ of the seat should be selected carefully.

According to the invention, the diameter $D_1$ of the seat 33 and the diameter $D_2$ of the compensating valve 36 are selected such that the flow rate of air at an intake vacuum level of, for example, −600 mmHg, deviated from a reference level of, for example, −500 mmHg, is maintained always at the upper side of the characteristic curve A corresponding to the reference intake vacuum as shown by the curve $B_1$ or always at the lower side of the characteristic curve A as shown by the curve $B_2$ in FIG. 3.

Figure 10:
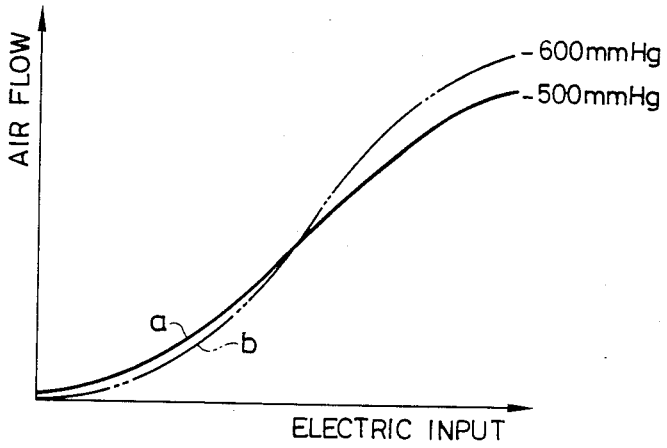
FIGS. 10 and 11 are air flow rate characteristic diagrams showing the air flow rates obtained in response to electric input to an electromagnetic driving section in a conventional device.
Figure 11:
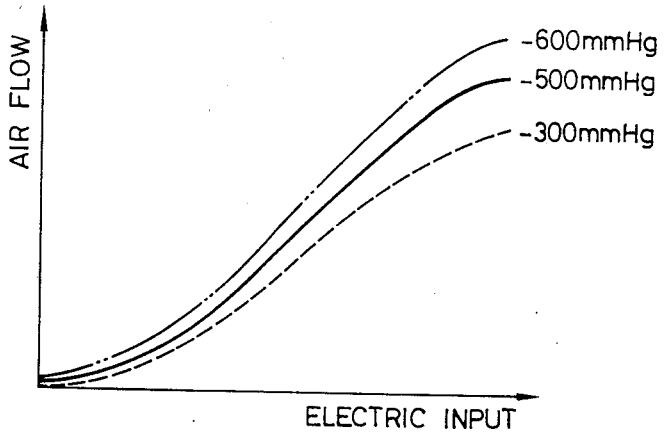

In the idle speed control device of the invention, therefore, the relationship as shown in FIG. 3 is maintained over the entire stroke and input region, so that a constant tendency of flow rate change in response to the change in the differential pressure is maintained over the entire input region, in sharp contrast to the conventional device in which, as shown in FIG. 10, the characteristic curves cross each other at a certain level of the input. This in turn facilitates the construction of softwares for the idle control such as to attain a desired warm-up characteristics, cold start-up characteristics, deceleration control and so forth. In addition, the software can be simplified as compared with the case of the conventional device which requires different software for both sides of the point at which the flow rate characteristic curves a and b cross each other as shown in FIG. 10. In consequence, the remaining portion of the capacity can be utilized for other purposes.

The idle speed control device of the described embodiment has a valve driven through a rod of the electromagnetic driving portion such that the fluctuation of the intake pressure is absorbed by arranging such that the forces produced by the intake vacuum act in opposite directions so as to engage each other. Namely, a metering valve is provided on one end while a compensating valve, which is designed to produce a pressure differential force smaller or greater than the metering valve is provided on the other end and is loosely received by the sleeve keeping a predetermined clearance therebetween. According to this arrangement, the inversion of the flow rate characteristic curves A and $B_1$,$B_2$ due to influence of the pressure differential is eliminated. Namely, the actual flow rate characteristic is maintained always above or below the reference flow rate characteristic curve A, so that the fluctuation in the idle speed and, hence, unfavourable hunting, is avoided advantageously. In addition, since the software used for the idle speed control is simplified, the memory capacity of the control unit can be utilized for other purposes. In addition, since only one metering valve is used, the flow-rate matching is simplified and the device can promptly response to various values demanded by the engine.

Figure 4:
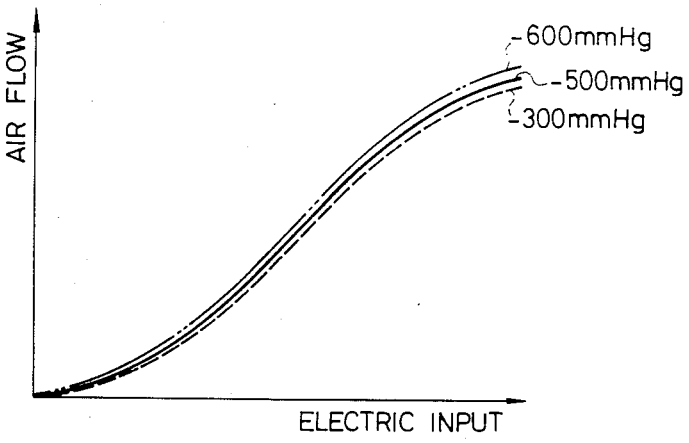

It is to be noted also that the output air flow rate which is determined in response to the level of the electric input is never affected by the input vacuum, as will be seen from FIG. 4. In addition, since the flow from the vacuum compensating portion can be minimized, the vacuum compensation is made possible without causing any increase in the initial leak, thus allowing the application of the device even to the engines which idle at low speed.

Embodiment 2

Figure 5:
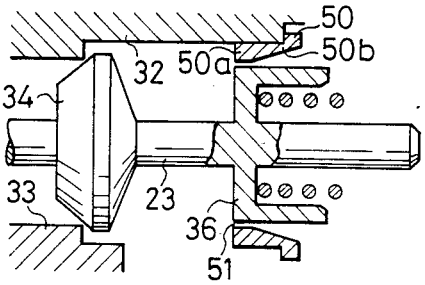
FIG. 5 is a sectional view of an essential part of the flow rate controlling portion in another embodiment of the idle speed control device of the invention.

FIG. 5 shows another embodiment of the invention. This embodiment is different from the first embodiment in that the inner periphery of the sleeve 50 used in this embodiment has a cylindrical portion 50*a* and a conical portion 50*b*, in contrast to the sleeve 35 of the first embodiment having a straight cylindrical portion. More specifically, the end surface of the cylindrical portion 50*a* of the sleeve 50 and the end surface of the compensating valve 36 substantially coincide with each other when the metering valve 34 is in the closing state. When the metering valve 34 is moved in the opening direction from the closing position, the cross-sectional area of the opening between the sleeve 50 and the compensating valve 36 is not changed until the end surface of the compensating valve 36 passes the cylindrical portion 50*a*, but is progressively increased after the end surface of the compensating valve 36 has passed the cylindrical portion 50*a*.

When the stroke of the metering valve 34 is small, the pressure differential across the metering valve 34 is large because the flow rate is small. However, as the stroke is increased, the pressure drops in other passages than the metering valve 34 are increased so that the pressure differential across the metering valve 34 becomes correspondingly small. It is to be noted also that, when the flow rate is increased, the influence of the momentum of air with respect to the position of the metering valve 34 provides a greater effect than the pressure differential across the metering valve 34 does. For these two reasons, when the stroke of the metering valve 34 is large, the demand for the compensation for the pressure differential in the idle speed control becomes less severe.

In the embodiment described above, when the input is small so that the compensation for the differential pressure is necessary, the clearance 51 between the compensating valve 36 and the cylindrical portion 50*a* of the sleeve 50 is maintained constant because the stroke is still small, so that a labyrinth effect is produced to effect a compensation for the pressure differential. On the other hand, in the region of large input in which the compensation for the pressure differential is not necessary, the clearance 51 formed between the conical portion 50*b* of the sleeve 50 and the compensating valve 36 is progressively increased as the stroke of this valve is increased, so that the flow rate of air through the clearance 51 is progressively increased thus producing the desired flow-rate increasing effect.

In this embodiment, the sleeve 50 having a cylindrical portion 50*a* and a conical portion 50*b* is provided to cooperate with the compensating valve 36 which is constructed integrally with the metering valve 34. Therefore, when the metering valve 34 is moved from the closing position in the opening direction, a pressure differential compensation is effected by the clearance 51 formed between the metering valve 34 and the cylindrical portion 50*a* in the region of small input such as to cope with the demand for such compensation, whereas, in the input region which does not require such a pressure differential compensation, the flow rate can be increased because the size of the clearance 51 formed between the conical portion 50*b* and the metering valve 34 is progressively increased in accordance with the increase of the stroke of the compensating valve 36. In order to cope with the demand for variation of the maximum flow rate according to the type or size of the automotive engine, it is possible to suitably change the apex angle of the conical portion 50*b*, thus affording a greater adaptability to a wide variety of the flow rate characteristics.

The same effect will be produced by changing the gradient of the surface of the metering valve 34 for contacting the seat 33, in such a way as to permit a progressive increase of the flow rate in the region of large input in which the level of the electric input to

Embodiment 3

Figure 6:
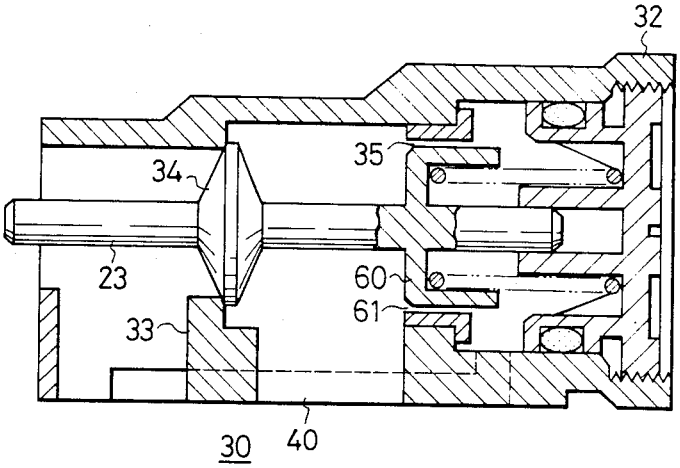
FIG. 6 is a partial sectional view of the flow rate controlling section of still another embodiment of the idle speed control device of the invention.

Still another embodiment will be described. Referring to FIG. 6, the metering portion 30A of the flow rate control portion is composed of a single seat 33 and a single metering valve 34.

On the other hand, the vacuum compensating portion 30B is constituted by a sleeve 35 and a compensating valve 60 which has a pressure receiving area equal to that of the metering valve 34. The vacuum compensating portion 30B operates as a unit with the metering valve 34.

The vacuum compensating portion 30B has a clearance 61 which is formed between the sleeve 35 and the compensating valve 60. This clearance serves only to transmit a pressure but does not allow air to flow therethrough. Assuming that a vacuum P is impressed on the downstream side of the metering valve 34 in this embodiment, the same vacuum P is applied to the compensating valve 60. Since the pressure receiving area $S_1$ of the metering valve 34 and the pressure receiving area $S_2$ of the compensating valve 60 are equal to each other, the level of the static pressure applied to the metering valve 34 becomes equal to the level of the static pressure applied to the compensating valve 60.

In the idle speed control device of this embodiment, the stroke of the metering valve 34 is not affected by the level of the vacuum. In other words, the flow rate metered by the metering valve 34 is not affected by the level of the vacuum.

Embodiment 4

Figure 7:
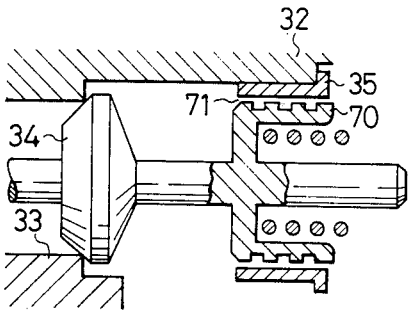
FIGS. 7,8 and 9 are sectional views of essential parts of flow rate controlling portions of different embodiments.

A further embodiment will be now described. The function of the vacuum compensating portion in the flow rate controlling portion is to transmit the vacuum while preventing the air from flowing therethrough. In this embodiment, therefore, the outer peripheral surface of the compensating valve 70 has a labyrinth type construction 71 as shown in FIG. 7. According to this arrangement, since the eddy currents of air are produced in the labyrinth construction 71 so as to nullify the flow energy, thus attaining an appreciable sealing effect. However, according to the result of the experiment conducted by the inventors, the sealing effect was materially the same as that produced by the compensating valve 60 of Embodiment 3 shown in FIG. 6 having a smooth outer peripheral surface. On the other hand, the sliding resistance was increased undesirably.

Embodiment 5

Figure 8:
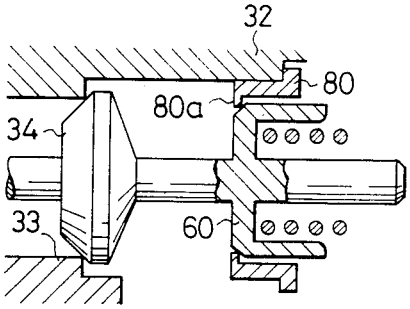

A still further embodiment improved to provide a still higher sealing effect will be described. Referring to FIG. 8, this embodiment has a ring portion 80*a* on a portion of the sleeve 80. The ring portion 80*a* is adapted for making a close contact with the compensating valve 60, thus preventing the flow of the air therethrough. According to this arrangement having the sealing ring portion 80*a* in the vacuum compensating portion 30B, the initial leak is further decreased as compared with the arrangement of Embodiment 3 shown in FIG. 6, thus facilitating the design of engine which can operate at low idle speed with reduced fuel consumption and noise.

Embodiment 6

Figure 9:
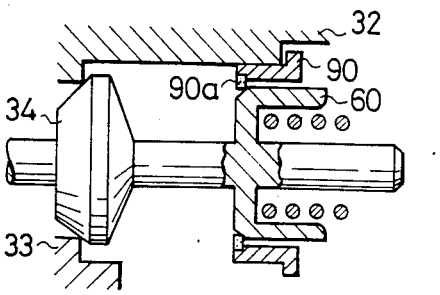

A still further embodiment will be described. Referring to FIG. 9, a ring portion 90*a* on the sleeve 90 is made from an elastic material such as rubber. In addition, the sleeve 90 is mounted with respect to the metering valve 34 and the compensating valve 60 such that the contraction tolerance $\pm\alpha$ becomes $-\alpha$. According to this arrangement, the metering valve 34 makes contact with the seat 33 without fail, while ensuring a tight contact between the elastic ring 90*a* on the sleeve 90 and the compensating valve 60, thus attaining a higher sealing effect.

We claim:

1. An idle speed control device comprising:

an electromagnetic driving portion having a coil, and a core and a plunger disposed in the coil, said electromagnetic driving portion being adapted to convert an electric input supplied thereto into a mechanical output, the electric input having been delivered to the coil from a processing unit which is designed to perform necessary computation upon receipt of signals from at least a water temperature sensor and a crank angle sensor; and a flow rate controlling portion disposed in a bypass passage formed in a throttle chamber to bypass a throttle valve, said flow rate controlling portion including a body defining a passage for the fluid to be controlled, a seat formed in an intermediate portion of the passage, a first valve for metering driven by the plunger of said electromagnetic driving portion through a rod to be brought into and out of contact with the seat, a sleeve disposed in the body, and a second valve for compensating connected through a rod to the downstream side of said first valve to produce a vacuum force which acts in the opposite direction to the vacuum force produced on said first valve thereby to absorb any fluctuation in the intake pressure in cooperation with said first valve, said second valve configured to produce a pressure differential force different from a pressure differential force produced by said first valve, wherein an outer peripheral surface of said second valve is a straight cylindrical portion, an inner peripheral surface of said sleeve is a straight cylindrical portion, said second valve is received in said sleeve to form a predetermined clearance between the outer peripheral surface of said sleeve and the inner peripheral surface of said second valve, and said predetermined clearance serves only to transmit the pressure and not allow the fluid to flow therethrough.

2. An idle speed control device according to claim 1, wherein the diameter of the seat is larger than the diameter of said second valve, so that the pressure receiving area of said first valve is larger than the pressure receiving area of said second valve in the region of contact the seat and said first valve.

3. An idle speed control device according to claim 1, wherein the pressure receiving area of said first valve and the pressure receiving area of said second valve are equal to each other, and the level of the static pressure applied to said first valve becomes equal to the level of the static pressure applied to said second valve.

4. An idle speed control device according to claim 1, wherein the outer peripheral surface of said second valve has a labyrinth construction.

5. An idle speed control device according to claim 1, wherein said sleeve has a ring portion formed integrally therewith on a tip thereof, and said ring portion is adapted for making a close contact with the outer peripheral surface of said second valve and preventing the flow of the fluid therethrough.

6. An idle speed control device according to claim 1, wherein said sleeve has a ring portion made from an elastic material on a tip thereof, and said ring portion makes a close contact with the outer peripheral surface of said second valve and prevents the flow of the fluid therethrough.

7. An idle speed control device comprising:

an electromagnetic driving portion having a coil, and a core and a plunger disposed in the coil, said electromagnetic driving portion being adapted to convert an electric input supplied thereto into a mechanical output, the electric input having been delivered to the coil from a processing unit which is designed to perform necessary computation upon receipt of signals from at least a water-temperature sensor and a crank angle sensor; and a flow rate controlling portion disposed in a bypass passage formed in a throttle chamber such as to bypass a throttle valve and including a body defining a passage for the fluid to be controlled, a seat formed in an intermediate portion of the passage, a first valve driven by the plunger of said electromagnetic driving portion through a rod such as to be brought into and out of contact with the seat, a sleeve disposed in the body, and a second valve connected through a rod to the downstream side of said first valve such as to produce a vacuum force which acts in the opposite direction to the vacuum force produced on said first valve thereby to absorb any fluctuation in the intake pressure in cooperation with said first valve, said second valve being loosely received by said sleeve, said second valve is constructed such as to produce a different force by pressure differential from that produced by said first valve, and is received in said sleeve such as to form a predetermined clearance therebetween, and wherein the inner peripheral surface of said sleeve has a cylindrical portion which forms between itself and said second valve a constant clearance when said first valve has been opened to a position corresponding to a small input to said electromagnetic driving portion, sand a conical portion which forms between itself and said second valve a clearance which is progressively increased as said first valve is opened to a greater degree in response to greater input to said electromagnetic driving portion.

8. An idle speed control device according to claim 7, wherein an end surface of said sleeve and an end surface of said second valve substantially coincides with each other when said first valve is in closing state.

* * * * *